US006272878B1

(12) United States Patent
Chang

(10) Patent No.: US 6,272,878 B1
(45) Date of Patent: Aug. 14, 2001

(54) WINDOW TYPE AIR CONDITIONER

(75) Inventor: Woo Sung Chang, Dongkwang-dong (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/441,608

(22) Filed: Nov. 16, 1999

(30) Foreign Application Priority Data

Nov. 16, 1998 (KR) ..... 98-49071

(51) Int. Cl.[7] ..... F25D 23/12
(52) U.S. Cl. ..... 62/262; 62/515
(58) Field of Search ..... 62/262, 515

(56) References Cited

U.S. PATENT DOCUMENTS 3,279,211 * 10/1966 Merrick ..... 62/515
3,898,865 * 8/1975 Stewart et al. ..... 62/280
4,505,129 * 3/1985 Yamane et al. ..... 62/280
4,770,241 * 9/1988 McManus ..... 165/172
5,542,263 * 8/1996 Choi et al. ..... 62/262
5,950,446 * 9/1999 Tromblee et al. ..... 62/262
6,053,004 * 4/2000 Beppu et al. ..... 62/285

* cited by examiner

*Primary Examiner*—William Doerrler
*Assistant Examiner*—Mark Shulman

(57) ABSTRACT

An air conditioner containing a shroud provided with an orifice through which outdoor air passes due to the turning power of a blowing fan, an outdoor heat exchanger for providing heat exchange with the air, and an end plate for supporting the outdoor heat exchanger, wherein one side of the outdoor heat exchanger is bent so as to provide an increase in the heat-exchanging area and one side of the shroud is formed with a groove for receiving the bent portion of the outdoor heat exchanger.

8 Claims, 6 Drawing Sheets

WINDOW TYPE AIR CONDITIONER

BACKGROUND OF THE INVENTION

The present invention relates to a window type air conditioner, more particularly, to the window type air conditioner having an increased heat-exchanging ability.

In general, the window type air conditioner maintains preferably an indoor temperature by exchanging a hot indoor temperature with a cold indoor temperature.

A conventional window type air conditioner, as shown in FIG. 1, includes a cabinet 1 having an indoor side and an outdoor side.

In the indoor side, the air conditioner comprises a front panel 2, an air guide 8 provided on a rear side of the air guide for guiding the indoor air, a blower 6 provided on the air guide 8 for indraft and discharge of the indoor air, a motor 7 connected to the blower 8, an indoor inlet 3 formed on one side of the front panel 2 for indrafting the hot air, an indoor heat exchanger 5 provided on a rear side of the front panel 2 for heat-exchanging between the hot air through the indoor inlet 3 and a refrigerant, an indoor outlet 4 formed on another side of the front panel 2 for discharging the air through the air guide 8 into the room, an up-down louver 9 provided on the indoor outlet 4 for up-down controlling the direction of air being discharged, a left-right louver 10 provided on the indoor outlet 4 for controlling the left-right direction of air being discharged, and a control box 11 provided on a lower side of the outlet 4 for controlling the air conditioner.

In the outdoor side, the air conditioner comprises an outdoor inlet 12 formed on outer side of the cabinet 1, a blowing fan 14 driven by a motor 7 for discharging the outdoor air through the outdoor inlet 12, a shroud 15 provided on an outer side of the blowing fan 14 for guiding the air through the outdoor inlet 12, an outdoor heat exchanger 16 provided on a rear side of the blowing fan 14 for heat-exchanging between the outdoor air entering through the outdoor inlet 12, a compressor 17 for compressing the hot refrigerant passing through the indoor heat exchanger 5 in a high temperature and high pressure atmosphere, and an outdoor outlet 13 for discharging the air through the outdoor heat exchanger 16.

The above-mentioned air conditioner further comprises a base 18 provided on a lower side of the cabinet 1 for supporting the above elements, and a condensate water groove 19 formed on one side of the air guide 8 for discharging the condensate water in the indoor region into the outdoor region.

When the summer air conditioning mode in the control box 11 is selected by the user, the blower 6 and blowing fan 14 are turned by the driving power from the motor 7.

Hot air from the indoor is drawn in through the indoor inlet 3 due to the turning power of the blower 6. The drawn in hot air becomes cold air by heat exchange with the indoor heat exchanger 5. The cold air passing through the air guide 8 is guided to the indoor outlet 4 and the cold air is discharged into the indoor with the up-down and left-right direction changing of louver 9 and louver 10, thereby maintaining the indoor temperature.

At this time, namely, when the indoor hot air passes through the indoor heat exchanger 5 where it is heat-exchanged with the cold refrigerant conveyed in the indoor heat exchanger 5, water condensate is generated. The condensate water is then discharged through the condensate water groove 19 formed on one side of the air guide 8 into the outdoor region.

High temperature refrigerant heat-exchanged with the indoor hot air is transferred to the compressor 17. The refrigerant is compressed in a high temperature and pressure atmosphere and discharged in to the outdoor heat exchanger 16. In the outdoor heat exchanger 16, the temperature of the refrigerant is reduced and conveyed into a capillary tube (not illustrated). The inhaled refrigerant is transferred to the indoor heat exchanger 5 at a low temperature and pressure atmosphere. At this time, the indoor hot air passing through the indoor heat exchanger 5 is heat-exchanged with the cold refrigerant being moved through the indoor heat exchanger 5.

The outdoor air passing through the outdoor heat exchanger 16 is heat-exchanged and thus the temperature of the air becomes high. The high temperature air of the outdoor is discharged into the outdoor through the outdoor outlet 13 by the turning power of the blowing fan 14.

The condensate water being drained through the condensate water groove 19 is evaporated through the outdoor heat exchanger 16 by heat exchange, using the turning power of the blowing fan 14.

As explained above, the outdoor air drawn in through the outdoor inlet 13 is guided to the outdoor heat exchanger 16 through the shroud 15.

Referring to FIG. 2, the shroud 15 comprises an orifice 20 through which passes the outdoor air from the outdoor inlet 12 due to the turning power of the blowing fan. The shroud utilizes a plurality of locking holes 25 for inserting a plurality of screws 27 therein, an upper plate 22 hinge-connected to the shroud for preventing the shroud 15 from the heat travelling through the upper side of the shroud 15 by the outdoor heat exchanger 16. A pair of projections 23 are formed on two upper sides of the upper plate 22 and, a pair of spigots 24 are provided for receiving the projection 23.

On the outdoor heat exchanger 16, an end plate 21 is provided for supporting the outdoor heat exchanger 16 and, a plurality of connecting holes 26 are provided for connecting the shroud 15 to the end plate 21.

In the conventional window type air conditioner, since the outdoor heat exchanger 16 to be connected to the rear side of the shroud 15 is formed linearly, the heat exchanging area by the outdoor heat exchanger 16 is limited and thereby it is difficult to increase the heat exchanging ratio.

Further, when the condensate water being drained according to the condensate water groove 19 is evaporated through the outdoor heat exchanger 16 by the turning power of the blowing fan 14, many stains on the outer surface of the air conditioner are created by the flowing of the condensate water. In addition, since the quantity of the condensate water to be dispersed to the outdoor heat exchanger 16 is small, the heat exchanging ratio is decreased and thus the efficiency of the apparatus is decreased.

On the other hand, it is hard to combine the outdoor heat exchanger 16 with the shroud 15 because it is difficult to locate correctly the outdoor heat exchanger 16.

SUMMARY OF THE INVENTION

It is an object of the present invention to provide a window type air conditioner having the broad heat-exchanging area by modifying the shapes of the shroud and the outdoor heat exchanger.

It is another object of the present invention to better accommodate for the large quantity of the condensate water and to control the outward flow of the condensate water.

It is still another object of the present invention to combine the outdoor heat exchanger with the shroud.

In order to achieve the above-mentioned objects, the air conditioner of the present invention includes a cabinet having an indoor side and an outdoor side.

In the outdoor side, the air conditioner comprises a shroud on which an orifice going through the outdoor air from the outdoor inlet by the turning power of the blowing fan is formed, an outdoor heat exchanger for heat-exchanging of the inhaled air, and an end plate for supporting the outdoor heat exchanger, wherein one side of the outdoor heat exchanger is bent so as to provide the broad heat-exchanging area and one side of the shroud is formed with an inserting groove for inserting the outdoor heat exchanger, especially the bent side of the outdoor heat exchanger.

BRIEF DESCRIPTION OF THE DRAWINGS

The present invention will become more fully understood from the detailed description given hereinbelow and the accompanying drawings which are given by way of illustration only, and thus do not limit the present invention.

DETAILED DESCRIPTION OF THE INVENTION

Preferred embodiments of the present invention are described in detail hereinafter in conjunction with the accompanying drawings.

Figure 1:
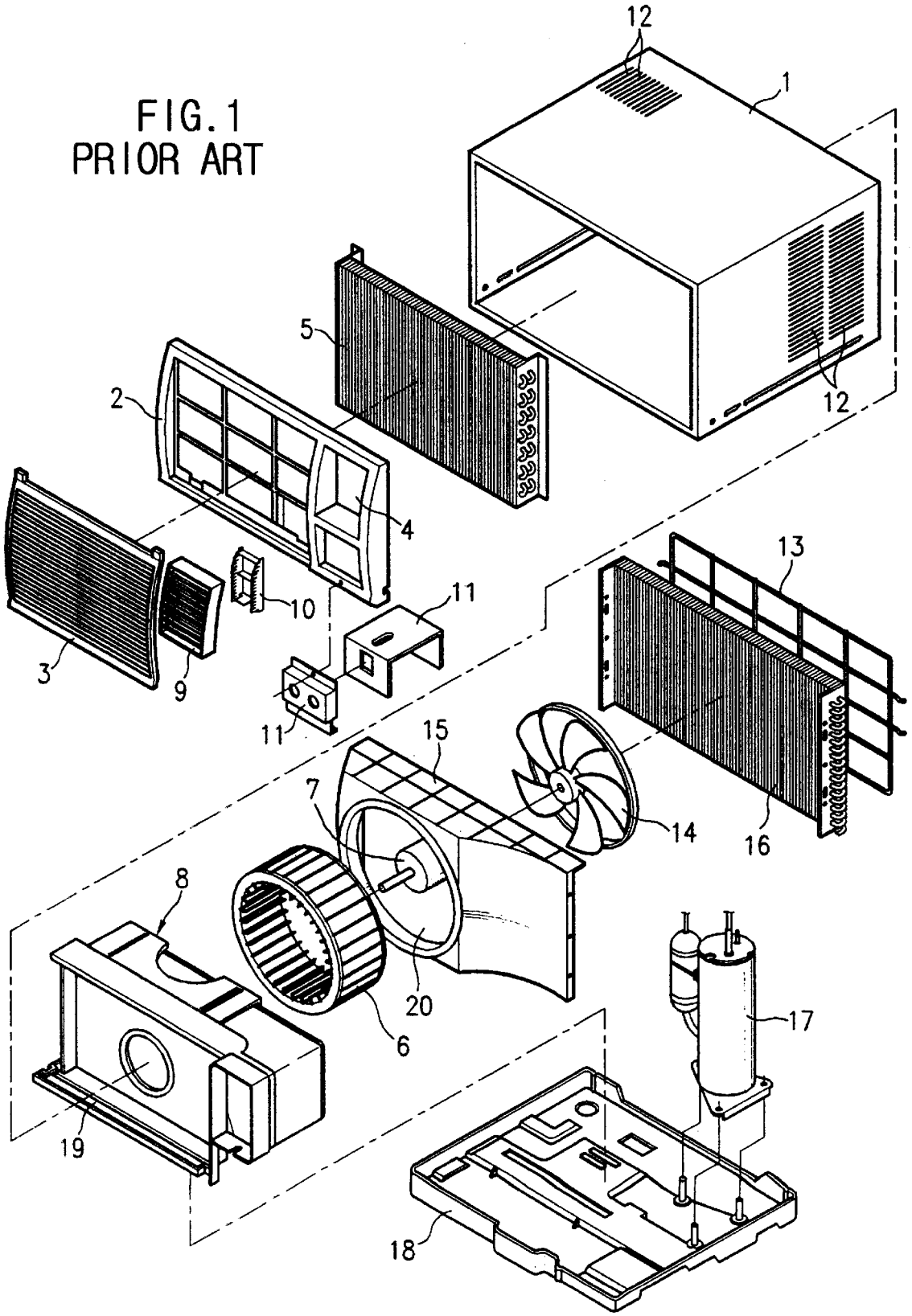
FIG. 1 PRIOR ART
FIG. 1 is a disassembled perspective view showing a general window type air conditioner.
Figure 2:
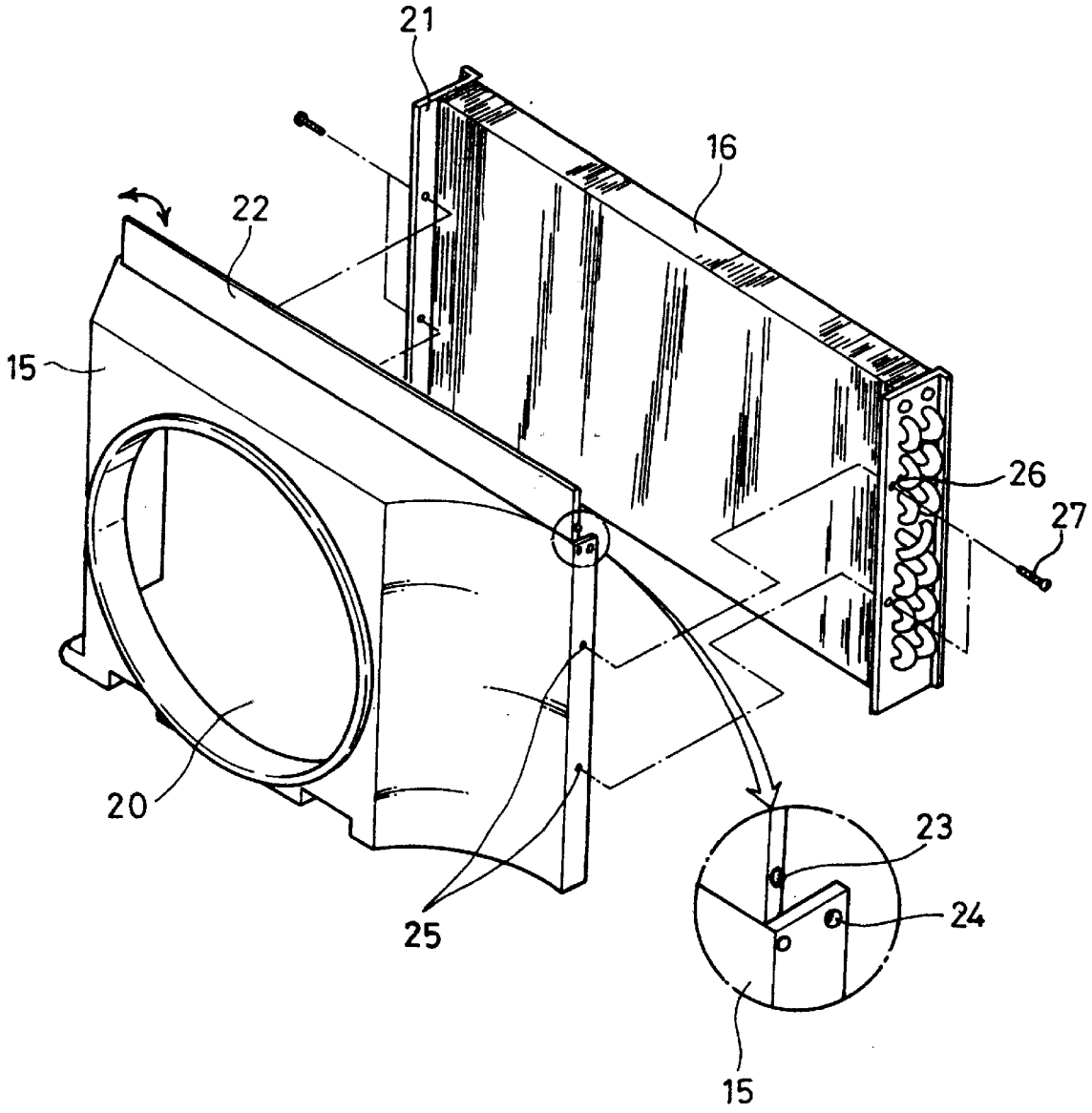
FIG.2 PRIOR ART
FIG. 2 is a disassembled perspective view showing a shroud and an outdoor heat exchanger according to a conventional air conditioner.
Figure 3:
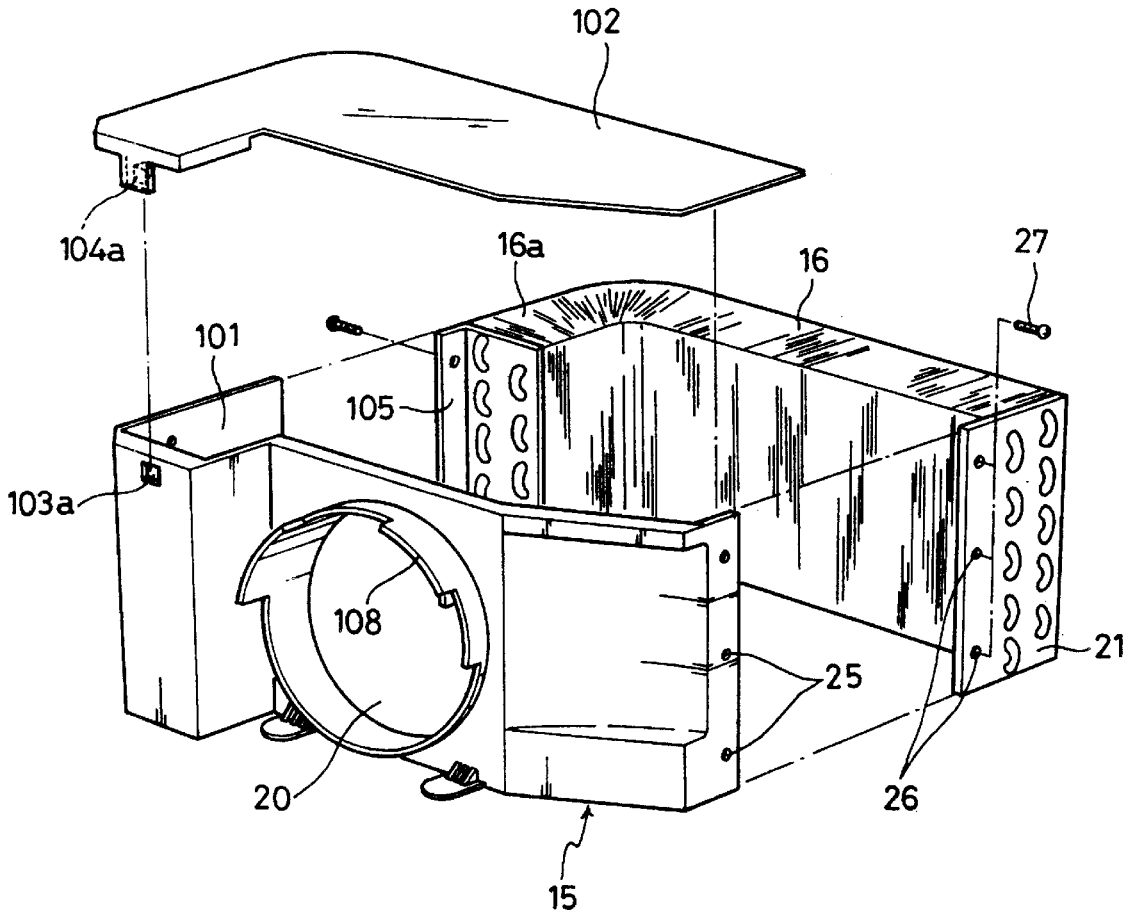
FIG. 3 is a disassemble perspective view showing a shroud and an outdoor heat exchanger according to the present invention.
Figure 4:
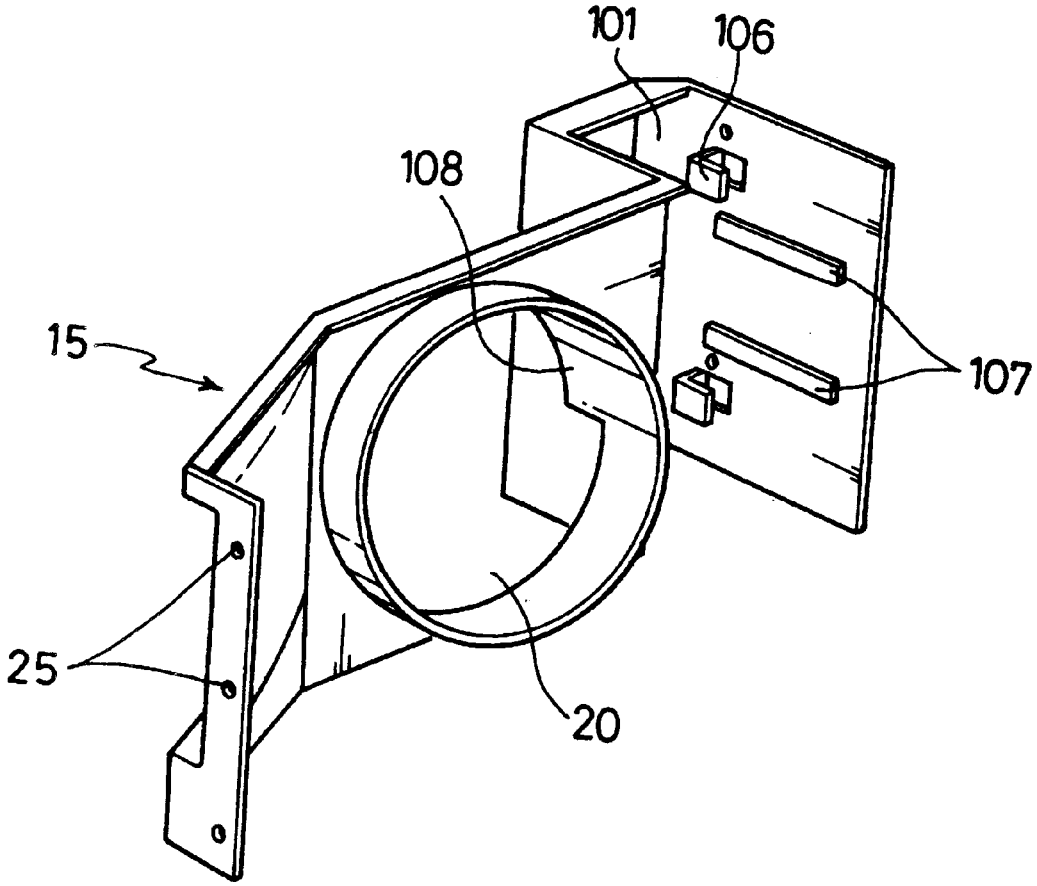
FIG. 4 is a perspective view showing a rear side of the shroud according to the present invention.
Figure 5:
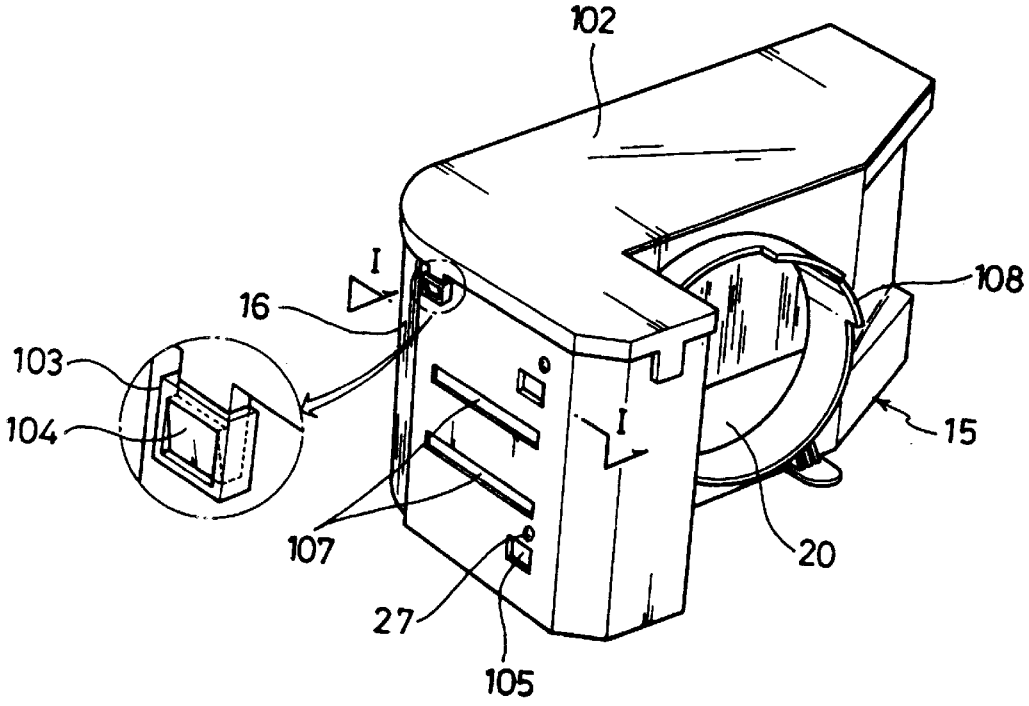
FIG. 5 is a perspective view showing a combination of the shroud and the outdoor heat exchanger according to the present invention.
Figure 6:
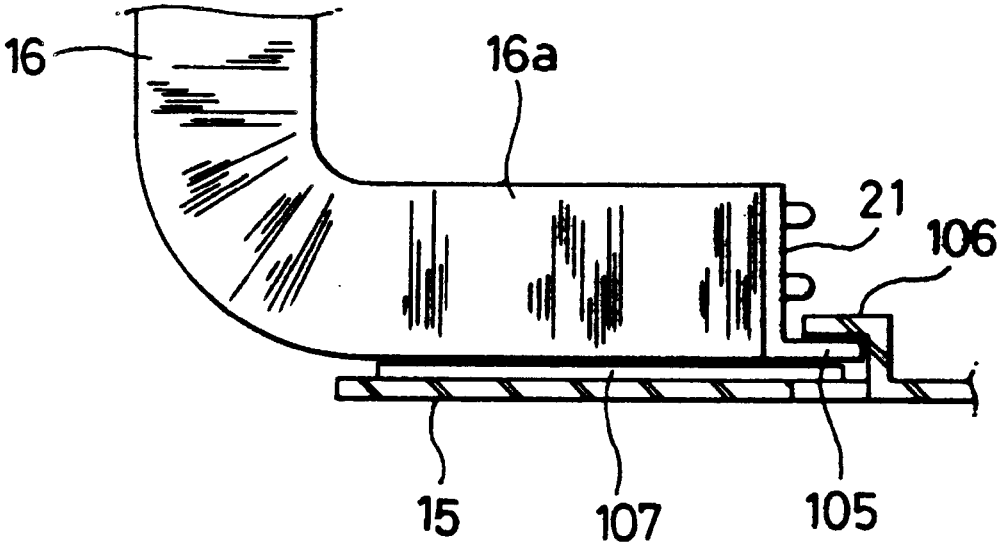
FIG. 6 is a sectional view taken along line I–I'.

FIG. 3 is a disassemble perspective view showing the shroud and the outdoor heat exchanger according to the present invention, FIG. 4 is a perspective view showing a rear side of the shroud according to the present invention, FIG. 5 is a perspective view showing a combination status of the shroud and the outdoor heat exchanger according to the present invention, and FIG. 6 is a sectional view taken along line I–I'.

As shown in drawings, the inventive air conditioner includes a cabinet 1 having an indoor side and an outdoor side.

A shroud 15 for guiding the outdoor air from an outdoor inlet 12 by the turning power of a blowing fan 14 is formed at the outdoor side. An orifice 20 going through the outdoor air from the outdoor inlet 12 is formed on the shroud 15. On two sides of the shroud, a plurality of locking holes 25 are formed.

On the rear side of the shroud 15, the outdoor heat exchanger 16 is provided for heat-exchanging with the drawn in air. An end plate 21 for supporting the outdoor heat exchanger 16 is formed on two sides of the outdoor heat exchanger 16. The end plate 21 includes a plurality of connecting holes 26 for connecting the shroud 15 to the end plate 21.

The outdoor heat exchanger 16 is provided with, a bent portion 16*a* which extends forwardly into the shroud so as to provide the broad heat-exchange area. Thus, a groove 101 is provided for receiving the bent portion 16*a* of the outdoor heat exchanger 16.

On the upper side of the shroud 15, a cover 102 is provided to prevent the heat from exiting through the shroud 15 when heat-exchanging is generated by the outdoor heat exchanger 16. On the one side of the shroud 15, a plurality of hanging holes 103, 103*a* are formed. On the one side of the cover 102, a plurality of hooks 104, 104*a* are provided for connection with the hanging holes 103, 103*a*.

A sign 105 represents a folding portion formed on the end plate 21 and, a sign 106 represents a plurality of locking portions 106 for the insertion of the folding portion 105.

A sign 107 represents a plurality of ribs for separation of the inner side of the shroud 15 and the outer side of the outdoor heat exchanger 16 at any distance so that pins on the outdoor heat exchanger 16 may be prevented from bending or breaking and the heat-exchanged air may be passed smoothly into the shroud 15 when the shroud 15 and the outdoor heat exchanger 16 are combined.

A sign 108 represents a water splash preventing member for smoothly dispersion of the condensate water into the outdoor heat exchanger 16 and for preventing the discharging of the condensate water by the turning power of the blowing fan 14 to the outer side of the cabinet 1. The water splash preventing member 108 is cut so as to prevent the interference between the member 108 and other elements. It is preferable that the water splash preventing member is in the shape of half-circle.

The outdoor air is drawn into the outdoor side from the outdoor inlet 12 by the turning of the blowing fan 14. The circulating air is discharged to the outer side of the cabinet 1 through the orifice 20 after heat-exchanging with the outdoor heat exchanger 16.

Combination of the outdoor heat exchanger 16 and the shroud 15 will be explained hereinafter.

The bending portion 16*a* is formed on one side of the outdoor heat exchanger 16 and extends forward, into the groove 101 of the shroud the bending portion 16*a* of the outdoor heat exchanger 16 is formed on the counter region for the bending. The shroud 15 is combined to the upper side of the base 18 and the bending portion 16*a* is inserted into the inserting groove 101. The outdoor heat exchanger 16 is located on the rear side of the shroud 15. When the outdoor heat exchanger 16 is pushed toward to the shroud 15, the bending portion 16*a* is inserted into the inserting groove 101. The inserting position of the outdoor heat exchanger 16 on the rear side of the shroud 15 is correctly positioned by inserting the folding portion 105 into the locking portion 106. The plurality of connecting holes 26 and the plurality of locking holes 25 can then be combined correspondently.

As described the above, since the plurality of connecting holes 26 and the plurality of locking holes 25 are combined correspondently, the outdoor heat exchanger 16 is located correctly on the rear side of the shroud 15 with screws 27.

After locating of the outdoor heat exchanger 16, the cover 102 is attached to the upper side of the shroud 15 to prevent the transfer of heat through the shroud 15 by that the plurality of hooks 104, 104*a* which are inserted into a plurality of hanging holes 103, 103*a*.

Further, after combination between the outdoor heat exchanger 16 and the shroud 15, the outdoor air is drawn into the outdoor side from the outdoor inlet 12 by turning on the blowing fan 14. The drawn in air is discharged to the outer side of the cabinet 1 through the orifice 20 after heat-exchanging with the outdoor heat exchanger 16 which has a larger heat-exchanging area due to the bending portion 16*a*.

The plurality of ribs 17 are formed on the one side of the shroud 15, namely on the inner side on which the inserting groove 101 is formed, so as to separate the inner side of the shroud 15 from the outer side of the outdoor heat exchanger 16 at any distance so that pins on the outdoor heat exchanger 16 may be prevented from being bent or broken. The heat-exchanged air may be passed into the shroud 15 when the shroud 15 and the outdoor heat exchanger 16 are combined, the heat-exchanged air from the outdoor heat exchanger 16 is passed smoothly in the shroud 15.

On the other hand, the condensate water being discharged to the outdoor from the indoor using the condensate water groove 19 is dispersed by the turning power of the blowing fan 14. At this time, the condensate water is prevented from dispersing to the outer side of the cabinet 1 by the water splash preventing member 108 and thereby the heat-exchanging efficiency is increased.

The water splash preventing member 108 is cut so as to prevent interference between the member 108 and other elements.

To separate the outdoor heat exchanger 16 from the shroud 15, the shroud 15 is separated from the cabinet 1, the cover 102 is separated from the shroud 15 by separeting the plurality of hooks 104, 104*a* from the plurality of hanging holes 103, 103*a*, the plurality of screws 27 are separated from the shroud 15 and the outdoor heat exchanger 16 is pulled toward the upper side or the rear side of the shroud 15 whereby the folding portion 105 is separated from the locking portion 106.

According to the present invention, it is possible to achieve a broad heat-exchanging area by forming the bending portion which extends forward towards shroud and the inserting the bending portion of the outdoor heat exchanger on the counter region for the bending portion into the groove thereby insuring that a large quantity of the outdoor air is passed through the outdoor heat exchanger.

Further, the heat-exchanging efficiency is increased whereby the condensate water is prevented from being dispersing toward the outer side of the cabinet by the water splash preventing member on the outer side of the orifice and the inner side of the shroud and the outer side of the outdoor heat exchanger are separated from each other at any distance by the rib.

What is claimed is:

1. A window type air conditioner, comprising:

a cabinet having an indoor side and the outdoor side, said cabinet being provided with an outdoor inlet, a fan, a shroud operatively associated with said fan and provided at said outdoor sides, said shroud containing an orifice through which outdoor air is conveyed from said outdoor inlet by the power of said fan; and an outdoor heat exchanger operatively associated with said shroud for heat-exchanging the air drawn through said outdoor inlet, wherein one side portion of said outdoor heat exchanger is bent so as to provide an extended heat-exchanging area and one side of said shroud is provided with a groove for receiving the bent, side portion of said outdoor heat exchanger.

2. The window type air conditioner according to claim 1, wherein a cover is provided on the upper side of said shroud and said outdoor heat exchange for preventing the transfer of heat therethrough.

3. The window type air conditioner according to claim 2, wherein said cover is combined with said shroud by a plurality of hooks formed on said cover and a plurality of hanging holes formed on said shroud.

4. The window type air conditioner according to claim 1, wherein folding portions are formed on an end plate of said outdoor heat exchanger and a plurality of locking portions are provided in said shroud for insertion into said folding portions.

5. The window type air conditioner according to claim 1, wherein a plurality of ribs are formed on the inner side of said shroud so as to separate the inner side of said shroud from the outer side of said outdoor heat exchanger.

6. The window type air conditioner according to claim 1, wherein a water splash-preventing device is formed on said orifice.

7. The window type air conditioner according to claim 1, wherein the water splash-preventing device is in the shape of a half-circle.

8. The window type air conditioner according to claim 6, wherein the water-splash preventing device is structured to avoid conflict with other structural members.

* * * * *